US006481534B1

(12) United States Patent
Malone, Jr.

(10) Patent No.: US 6,481,534 B1
(45) Date of Patent: Nov. 19, 2002

(54) APPARATUS FOR MAINTAINING ADEQUATE OVERHEAD SPACE FOR CAR TOP MECHANICS IN ELEVATOR SYSTEMS

(75) Inventor: Thomas F. Malone, Jr., Avon, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/940,119

(22) Filed: Aug. 27, 2001

(51) Int. Cl.[7] ..... B66B 5/16
(52) U.S. Cl. ..... 187/377; 187/356; 187/314
(58) Field of Search ..... 187/276, 277, 187/300, 301, 313, 314, 406, 351, 356, 359, 363, 366, 376, 378, 379, 374, 391, 377

(56) References Cited

U.S. PATENT DOCUMENTS

| | | | | | |
|---|---|---|---|---|---|
| 787,258 | A | * | 4/1905 | Austin | 187/276 |
| 3,687,237 | A | * | 8/1972 | Capra | 187/206 |
| 4,015,689 | A | * | 4/1977 | Johnson | 187/277 |
| 5,727,657 | A | | 3/1998 | Foelix | 187/356 |
| 5,773,771 | A | * | 6/1998 | Chatham | 187/276 |
| 6,138,798 | A | * | 10/2000 | Macuga | 187/294 |
| 6,202,801 | B1 | * | 3/2001 | Muller et al. | 187/269 |
| 6,223,861 | B1 | * | 5/2001 | Sanservero | 187/316 |
| 6,382,361 | B2 | * | 5/2002 | Nihei et al. | 187/289 |

FOREIGN PATENT DOCUMENTS

| | | | | |
|---|---|---|---|---|
| JP | 02291377 | A * | 12/1990 | B66B/5/00 |
| JP | 03067885 | A * | 3/1991 | B66B/9/04 |
| JP | 03158370 | A * | 7/1991 | B66B/5/02 |
| JP | 04059582 | A * | 2/1992 | B66B/5/00 |
| JP | 05330752 | A * | 12/1993 | B66B/5/00 |

* cited by examiner

*Primary Examiner*—Jonathan Salata

(57) ABSTRACT

Apparatus for maintaining adequate overhead space for a worker located upon the roof of an elevator car having a drive mechanism that disengages under a given load. A brace is secured to the car and is capable of withstanding a compressive load that is greater than the disengagement load of the drive mechanism.

15 Claims, 2 Drawing Sheets

APPARATUS FOR MAINTAINING ADEQUATE OVERHEAD SPACE FOR CAR TOP MECHANICS IN ELEVATOR SYSTEMS

FIELD OF THE INVENTION

This invention relates generally to a traction elevator system, and specifically to an apparatus for protecting maintenance personnel working on the roof of an elevator car.

BACKGROUND OF THE INVENTION

As is well known in the art, much of the maintenance work on elevators is conducted upon the roof of the elevator car. To this end, an inspection box is mounted upon the roof of the car which has controls allowing a maintenance worker stationed upon the car roof to operate the elevator. More and more traction elevator systems are being built in which most of the mechanical components that were traditionally housed in the machine room are now being located in the hoistway. The top of the hoistway is closed by a ceiling that leaves little headroom between the elevator car roof and the ceiling when the car is stationed at the top floor landing. Accordingly, a maintenance worker located on the roof of the car can run the car extremely close to the top of the hoistway using the inspection box controls. Accordingly, a maintenance worker on the roof of the car may become entrapped between the car roof and the structure located in the top section of the hoistway.

SUMMARY OF THE INVENTION

It is therefore an object of the present invention to improve elevator systems.

It is a further object of the present invention to improve the safety of elevators.

A still further object of the present invention is to maintain adequate overhead space for a worker while he or she is situated upon the rooftop of an elevator car.

A preferred feature of the invention is to disable the up function of the elevator's inspection box control circuitry until such time as preventative measures have been carried out to prevent a worker on top of the elevator car from becoming entrapped between the car and the structure located in the top of the hoistway.

These and other objects and features of the present invention are attained in an embodiment in which an elevator system that includes a drive mechanism that is arranged to disengage at a predetermined load resistance. A brace is mounted to the elevator car and preferably extends above the car. The brace is capable of withstanding a compressive load that is higher than the disengagement load of the drive mechanism whereupon the drive mechanism will disengage in the event an upwardly moving car raises the brace into contact with an overhead structure of the hoistway.

BRIEF DESCRIPTION OF THE DRAWING

For a better understanding of these and other objects and features of the invention, reference will be made to the following detailed description of the invention which is to be read in connection with the accompanying drawing, wherein.

DETAILED DESCRIPTION OF PREFERRED EMBODIMENTS OF THE INVENTION

Figure 1:
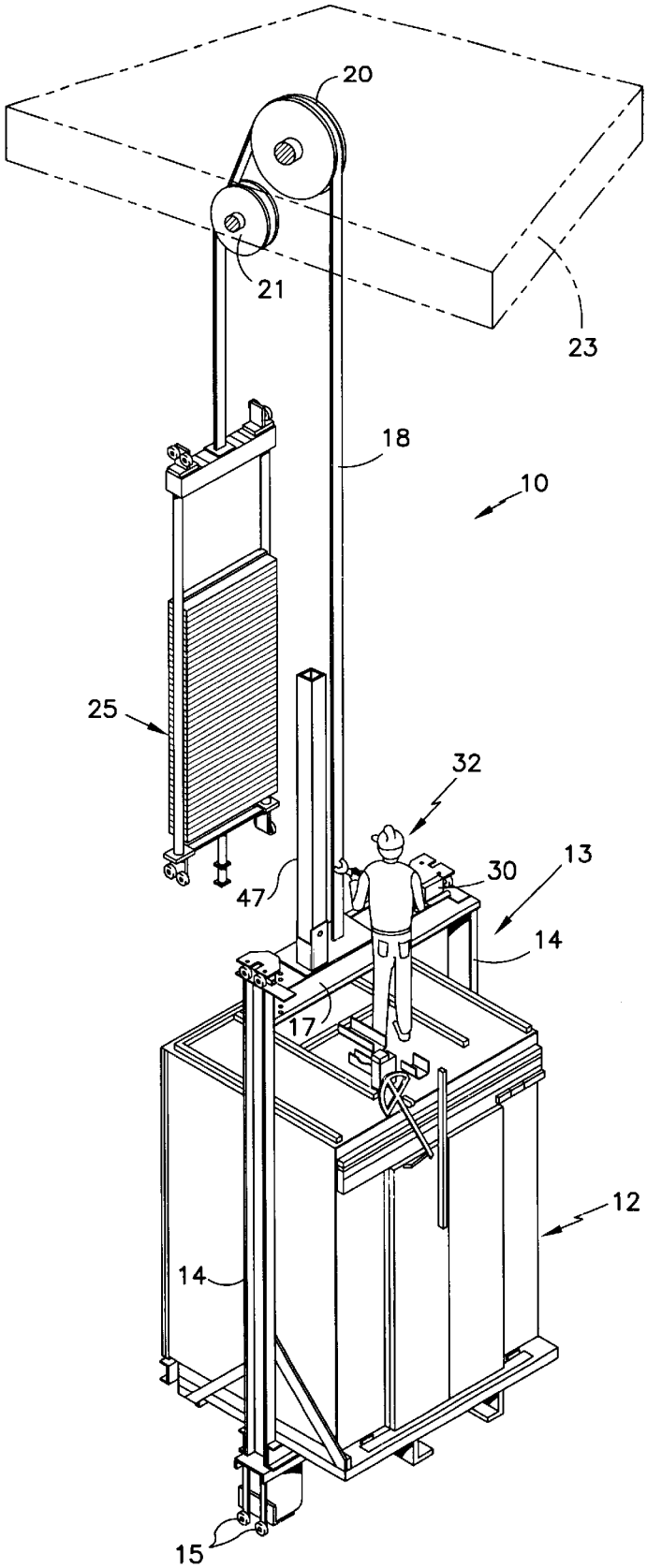
FIG. 1 is a perspective view showing a traction elevator system embodying the teachings of the present invention.

Turning initially to FIG. 1, there is illustrated a traction type elevator system generally referenced 10 that embodies the teachings of a preferred embodiment of the present invention. The system 10 includes an elevator car 12 of well known construction that is supported inside a lifting frame 13. Side members 14 of the frame contain guide mechanisms equipped with rollers 15 that are arranged to ride along opposed guide rails (not shown) that extend vertically along the length of the hoistway.

The lifting frame includes a crosshead 17 that passes horizontally across the top of the car between the side members of the frame. Lifting ropes 18 are attached to the crosshead and the ropes trained over a drive sheave 20 and a deflection sheave 21 both of which are mounted in the hoistway close to the hoistway ceiling 23. The opposite ends of the lifting ropes are secured to a counterweight assembly 25 which, like the car lifting frame, is arranged to ride along vertically disposed guide rails located within the hoistway (not shown). The term lifting rope, as herein used, refers to any suitable flexible cable or belt, as known and used in the art, that is suitable for lifting an ax; elevator within the hoistway.

The motion of the car is obtained through friction between the lifting ropes and the traction drive sheave 20. The lifting ropes are passed over the drive sheave and one end of each rope is secured to the counterweight assembly. Accordingly, the ropes are tensioned on both sides of the drive sheave to develop the necessary drive friction to lift the elevator cab. As can be seen, the counterweight assembly assures that sufficient tension is developed on one side of the sheave. The weight of the car provides the needed opposing tension. An inherent safety feature is that traction is lost in the event the tension differential on the rope exceeds a given limit.

An inspection box 30 is mounted upon the crosshead 17 of the lifting frame. The box is connected to the car controller and permits a mechanic 32 situated upon the roof of the car to control the operation of the car from the roof. The inspection box allows the mechanic to move the elevator at very slow speed while he or she inspects the operation of various elevator system components. Accordingly, there presently exists the possibility, in the event of an inspection box failure or safety device override, of the car overtraveling past the uppermost landing and approaching or contacting structure in the top of the hoistway while a worker is situated upon the car roof. It should be further noted that more and more equipment is being located in the upper part of the hoistway in order to save space, further reducing the space available over the car.

Figure 2:
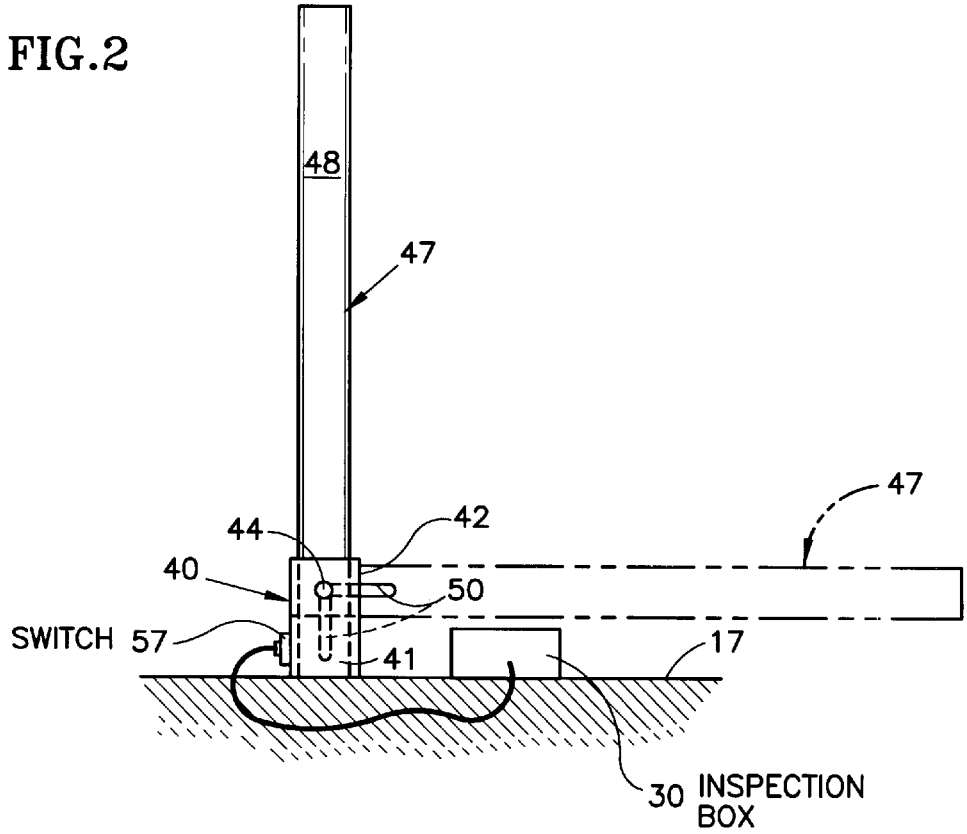
FIG. 2 is a partial enlarged front view illustrating an embodiment of the safety apparatus of the present invention.

With further reference to FIG. 2, the present elevator is provided with a square shaped hollow sleeve 40 that is welded or otherwise connected to the crosshead 17 in a vertical or upright position. The sleeve includes a pair of opposed side walls 41 and a pair of opposed end walls 42. As illustrated in FIG. 1, the side walls extend to a higher elevation than the two end walls to establish a cutout in the upper part of the sleeve. A horizontally disposed pivot pin 44 extends across the cutout region and is secured in the upper section of each side wall.

An elongated square shaped hollow column 47 is rotatably mounted upon the pivot pin. In assembly, the pin is arranged to pass through opposed elongated slotted holes 50 formed in the side walls 48 of the column so that the column can rotate between a lowered position as shown in phantom outline in FIG. 2, into an upright position in axial alignment with the sleeve. The column, when placed in a vertical upright position can be slidably received within the sleeve. The column and the sleeve are sized to provide a close sliding fit between walls of the column within the sleeve. The axial length of the slotted holes 50 is sufficiently long to permit the column to bottom within the sleeve. Preferably, the axial length of the column when erected is sufficient that it extends upwardly to a height that is slightly higher than that of most workers that will stand upon the roof of the car. When maintenance is not being performed on the car, the column is moved out of the way into the lowered position.

The column 47 and sleeve 40 are preferably formed of low-carbon structural steel. Other ferrous alloys, such as other types of steel, and other materials, such as light alloys, polymers and composites, having sufficient compressive strength characteristics, may be used. Further, although the column 47 and sleeve 40 have been shown as square in cross-section, any suitable shapes may used, so long as the sleeve 40 can maintain the column 47 upright, and the column 47 can withstand a sufficient compressive load without buckling. For example, the column 47 can be a structural tube or an I-beam without substantially modifying the shape of the sleeve 40.

The column and the sleeve are sized so that the erected column can withstand a compressive load without buckling that is substantially greater than the slip load of the hoist system, that is, the load at which the rope slips upon the drive sheave. In that event, as the car approaches the ceiling structure of the hoistway with a maintenance worker situated upon the roof of the car, the raised column will strike the hoistway ceiling structure and halt the upward movement of the car. The load on the car-side hoist rope will rapidly exceed a point where the rope slips with respect to the drive sheave and thus prevents the rope or drive machine (not shown) from enduring undue stress.

A sensing switch 57 may be mounted to the base of the sleeve where it is cycled by the column as it is bottomed in the sleeve. The switch can be wired into the inspection box circuitry and arranged to prevent inspection operation in an upward direction (or in either direction, if desired) until such time as the column is fully seated within the sleeve. The switch can also be used to disable normal elevator operations when the column is upright, especially if the column could otherwise be lifted into overhead structures during normal operation of the car.

Figure 3:
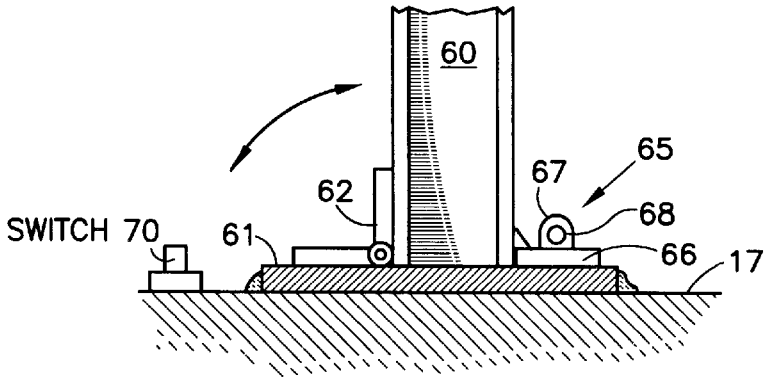
FIG. 3 is a view similar to FIG. 2 illustrating a further embodiment of the invention.

With reference to FIG. 3, there is illustrated a further embodiment of the invention. Here, the column is an I-beam 60 that is connected to a generous base plate 61 that is secured to the crosshead 17 by welds, bolts, screws, or other suitable fastener. The I-beam is preferably connected to the base plate by a hinge 62 that enables the beam to be rotated between a vertical position as illustrated and a stored horizontal position. A latch mechanism 65 can be used to secure the beam in an upright position. The latch mechanism can include a hasp 66 that is arranged to pass over a U-shaped staple 67 that is secured in the base plate when the beam is brought to an upright position. A pin 68 is passed through the staple 67 to lock the beam in an upright position.

In this embodiment, it is preferred that the column is an I-beam 60 formed of steel. As in the previous embodiment, other suitable shapes and materials can be employed.

A switch 70 can be mounted upon the crosshead 17 that senses when the beam is in a stored position. The switch can be wired into the inspection box control circuitry and serves to disable the up (or up and down) function control any time the beam is in a stored position, and/or disables normal operation when the beam is not stored.

While the present invention has been particularly shown and described with reference to the preferred mode as illustrated in the drawing, it will be understood by one skilled in the art that various changes in detail may be effected therein without departing from the scope of the invention, which is defined by the claims. For example, as noted, design variations on the column can include cross-sectional shape (structural tubing, open-section beams, etc.). Further, alternate crosshead mounting methods may be used. Alternately, the column may be mounted elsewhere on the lifting frame. Also, a contact plate (not shown) may be provided at the top of the hoistway at a location that the column would impact, or a resilient mount or device may be used to absorb the initial shock load of the column contacting the hoistway overhead structure. Since inspection speed is limited to 0.75 m/s or less per A17 code in the U.S., the stroke of an energy accumulating device, if used in the U.S., would only need to be about 65 mm. Further, other upright brace structures, such as an A-frame or the like, may be employed instead of a vertical column.

The subject invention has been discussed in the context of traction elevator systems, for which car-top maintenance and/or inspection are common. However, it should be noted that the subject invention can be employed in other systems such as, for example, a hydraulic elevator system having a pressure relief valve on the main lifting piston. In such a system, a brace mechanism would withstand sufficient compressive loading to trigger the pressure relief valve and halt upward movement of the car.

I claim:

1. An apparatus for maintaining adequate overhead space while a worker is performing maintenance work on a roof of an elevator car within a hoistway, comprising:

a car drive mechanism that disengages at a predetermined load, and a brace mounted to the elevator car, said brace extending above the car and being capable of withstanding a compressive load that is greater than the predetermined load, whereby when upward movement of the elevator car moves said brace into contact with an overhead structure in the hoistway the brace prevents further upward movement of the elevator car and causes the drive mechanism to disengage.

2. The apparatus of claim 1 wherein said brace is movable between an upright position and a lowered position.

3. The apparatus of claim 1 wherein said drive mechanism includes a lifting rope by which the elevator car is suspended, and a traction sheave for engaging and driving said rope, wherein said rope slips on said sheave at the predetermined load.

4. The apparatus of claim 1 wherein said brace is a structural column.

5. An apparatus for maintaining adequate overhead space while a worker is performing maintenance work on a roof of an elevator car within a hoistway, comprising:

a car drive mechanism that disengages at a predetermined load;

a brace mounted to the elevator car, said brace extending above the car and being capable of withstanding a compressive load that is greater than the predetermined load, whereby when upward movement of the elevator car moves said brace into contact with an overhead structure in the hoistway the brace prevents further upward movement of the elevator car and causes the drive mechanism to disengage, wherein said brace is a structural column; and a vertically disposed sleeve mounted atop the car for slidably retaining said column in an upright position.

6. The apparatus of claim 5 wherein the car is mounted inside a movable lifting frame, the lifting frame has a crosshead disposed above the roof of the car, and said sleeve is secured to the crosshead.

7. The apparatus of claim 5 wherein said sleeve and said column are rectangular tubes having opposed side walls and end walls.

8. The apparatus of claim 7 wherein the opposed side walls of the sleeve extend upwardly above the opposed end walls to establish two opposed cutouts in the top section of the column.

9. The apparatus of claim 8 further including a horizontally disposed pivot pin extending between the upwardly extended sections of the sleeve side walls, said pin passing through elongated slotted holes formed in the column side walls, said slotted holes extending axially along the lower section of the column wherein the column can be raised vertically within said sleeve and rotated into a horizontal stored position.

10. An apparatus for maintaining adequate overhead space while a worker is performing maintenance work on a roof of an elevator car within a hoistway, comprising:

a car drive mechanism that disengages at a predetermined load;

a brace mounted to the elevator car, said brace extending above the car and being capable of withstanding a compressive load that is greater than the predetermined load, whereby when upward movement of the elevator car moves said brace into contact with an overhead structure in the hoistway the brace prevents further upward movement of the elevator car and causes the drive mechanism to disengage, wherein said brace is movable between an upright position and a lowered position;

an inspection box mounted above the roof of the elevator car and containing circuit means for controlling the elevator car during inspection; and a switch that is actuated when said brace is in the upright position, enabling said circuit means to permit upward movement of the car during inspection only when said brace is in the upright position.

11. The apparatus of claim 10, wherein the switch disables normal elevator operation when said brace is in the upright position.

12. The apparatus of claim 1 that further includes hinge means for permitting rotation of said brace between an upright position and a lowered position.

13. The apparatus of claim 12 further including a latching mechanism for locking said brace in the upright position.

14. The apparatus of claim 12 that further includes an inspection box mounted above the car and having circuit means for controlling the car during inspection, and means for enabling said circuit means to permit upward movement of the car during inspection only when said brace is in the upright position.

15. The apparatus of claim 14, wherein said means for enabling also disables normal elevator operation when said brace is in the upright position.

* * * * *